US006558247B1

(12) United States Patent
Peak

(10) Patent No.: US 6,558,247 B1
(45) Date of Patent: May 6, 2003

(54) VENTILATOR

(75) Inventor: Richard Allan Peak, Colchester (GB)

(73) Assignee: Titon Hardware Limited, Colchester (GB)

( * ) Notice: Subject to any disclaimer, the term of this patent is extended or adjusted under 35 U.S.C. 154(b) by 0 days.

(21) Appl. No.: 09/463,799

(22) PCT Filed: Jul. 28, 1998

(86) PCT No.: PCT/GB98/02249

§ 371 (c)(1),
(2), (4) Date: Mar. 27, 2000

(87) PCT Pub. No.: WO99/06775

PCT Pub. Date: Feb. 11, 1999

(30) Foreign Application Priority Data

Jul. 29, 1997 (GB) ..... 9716000

(51) Int. Cl.[7] ..... E06B 7/02
(52) U.S. Cl. ..... 454/213; 454/195
(58) Field of Search ..... 454/195, 196, 454/213

(56) References Cited

FOREIGN PATENT DOCUMENTS

| | | | |
|---|---|---|---|
| DE | 19753485 | | 6/1998 |
| EP | 0327187 | | 7/1982 |
| EP | 0458725 | | 11/1991 |
| EP | 0327186 | | 7/1992 |
| EP | 0907055 | | 4/1999 |
| GB | 1417751 | | 12/1975 |
| GB | 2194328 | | 3/1988 |
| GB | 2194328 A | * | 3/1988 |
| GB | 2224826 | | 6/1990 |
| GB | 2253477 | | 9/1992 |
| JP | 08285339 | | 1/1996 |
| JP | 08032248 | | 2/1996 |
| NL | 9400786 | | 12/1995 |
| NL | 1002695 | | 9/1997 |
| NL | 1004664 | | 6/1998 |
| NL | 1007519 | | 9/1998 |

OTHER PUBLICATIONS

Handout, "Bulpren S", Date before Apr. 12, 1999, 4 pages.

* cited by examiner

*Primary Examiner*—Derek Boles
(74) *Attorney, Agent, or Firm*—Price, Heneveld, Cooper, DeWitt & Litton

(57) ABSTRACT

A ventilator (10) has a housing (12) including an apertured wall portion (14) an exterior weather hood (16) and a cover portion (18). A rotatable flap (42) is pivotally mounted to the apertured wall portion (24). The cover portion (18) contains a reticulated foam filter (120). The cover portion (18) is removable from the apertured wall portion (14) for servicing or replacement of the filter (120).

26 Claims, 6 Drawing Sheets

VENTILATOR

The present invention relates to ventilators such as glazed-in or slot ventilators for use at windows or doors where it is desirable to provide ventilation without having to open the window or door.

This application is the National Stage of International Application No. PCT/GB98/02249, filed Jul. 28, 1998, which claims priority to UK Patent Application No. 9716000.6, filed Jul. 29 1997.

A known slot ventilator is described in GB11417751.

A known glazed-in ventilator is described in GB-A-2224826. The ventilator comprises a body which is adapted to be located adjacent a window at a ventilation path between two sides of the window. The ventilator has a body or housing which is adapted to be located in a gap left between the top edge of a pane of glass and a peripheral spar of a window frame, usually the upper spar of a rectangular frame. An upper edge of the housing has substantially the same thickness as the panel of glazing itself and the ventilator fills the substantially rectangular gap between the panel of glazing and the upper spar of the frame which may be a sash frame.

This ventilator and the slot ventilator referred to above perform well in many applications, but in some circumstances it is possible for exterior debris, such as dust, to be carried through these ventilators into the room which they serve.

The present invention aims to alleviate the problems of the prior art.

According to a first aspect of the present invention there is provided a ventilator comprising a body or housing which is adapted to be located adjacent a window or door at a ventilation path between two sides of the window or door, the body including a filter for filtering air passing through the ventilator. The ventilator is therefore advantageously able to provide ventilation of substantially cleaner air to a room since debris such as dust will be caught by the filter. Preferably the filter is removable from the body, preferably once the body is in situ in a window or door assembly.

Preferably, the body includes a chamber containing the filter, and at least part of the chamber is defined by a removable cover portion of the body, the filter being removable from the body once the cover has been removed or on removal of the cover portion. This enables the filter easily to be cleaned or replaced when servicing is desirable. This construction is considered to be particularly inventive. Previously, slot ventilators or glazed-in ventilators have been located as permanent fixtures in window or door assemblies and the incorporation of a cover portion and/or filter which may be removed from the body while the ventilator is in situ at a window or door assembly is considered a considerable advance.

According to a further aspect of the invention there is provided a ventilator comprising a body or housing which is adapted to be located adjacent a window or door at a ventilation path between two sides of the window or door, the body including a chamber which is adapted to contain a filter for filtering air passing through the ventilation path. Preferably, the chamber contains a filter, and at least part of the chamber is defined by a removable cover portion of the body or housing, the filter being removable from the body or housing on removal of the cover portion or once the cover portion has been removed. The advantages of this structure will be apparent from the above text, notably that the filter may be easily removed from the ventilator, while the ventilator is in situ, for servicing by cleaning or replacing the filter.

According to another aspect of the invention a ventilator (such as for use at a window door or wall) comprises a body and a filter in the region of the body for filtering air passing through the body.

A number of preferred features which are applicable to each of the above mentioned aspects of the invention will now be discussed.

Preferably, where the ventilator includes a said chamber with a said cover portion, the chamber is partly defined by an apertured wall portion of the body, the cover portion being removably mounted to the apertured wall portion, the ventilator being adapted to be mounted in a window or door assembly with the cover portion on an interior side of the window or door. Therefore, the cover portion and filter may conveniently be removed from the rest of the ventilator by a person on the inside of the window or door.

The body or housing may include a closure for controlling the level of ventilation through the ventilator. In this case, the closure may comprise a flap which is pivotally coupled to the apertured wall portion on one side thereof, the filter and cover portion being located on an opposite side thereof.

The ventilator may comprise a glazed-in ventilator for a window assembly, the ventilator being adapted to be located at an elongate rectangular gap between a pane of glazing and a peripheral spar of a window. Preferably, the body or housing is elongate. The body may include a weather hood and the ventilator may be adapted to be mounted at a window or door assembly with the weather hood on an exterior side of the window or door. The weather hood, apertured wall portion and cover portion of the housing, where such are provided, may each be formed as elongate extrusions. The ventilator may include an end cap at one or each end of the housing or body for securing parts of the body, e.g. the apertured wall portion and weather hood together. The end cap may include an end wall portion for forming an end wall of the chamber, partly defined by the cover portion, where such are provided.

When a filter is provided, it preferably comprises a reticulated foam filter. The filter may be provided as a brick or blocklike element of material.

The filter is preferably a foam filter which is substantially fully open celled, preferably at least 90% to 100% of the cells by number being opened. The foam may be a polyurethane foam.

The porosity of the foam of the filter, when it is a foam filter, may be between 7 and 100 pores per inch, one example having between 7 and 15 pores per inch and another about 10 pores per inch. A straight line through the foam may, on average, pass through between 7 and 100 pores per inch, e.g. 7 to 15 pores per inch or about 10 pores per inch. Therefore, the foam is relatively porous to air flow and does not substantially restrict mass flow rate through the ventilator. The average diameter of pores or cells in the foam filter may be about half to 5 mm, or 1 to 3 or 1 to 2 mm in diameter. The foam filter is preferably an unskinned foam.

The foam of the filter preferably has a density of about 20 to 40 kg per cubic metre, about 26 to 32 kg per cubic metre being employed in some applications.

When the filter is a reticulated foam, it is envisaged that the volume of foam ribs of the foam filter may be 1 to 10% or 2 to 5% and preferably about 3% of the overall volume of the foam filter.

The above discussed parameters of the foam filter may be contrasted with those of typical acoustic foams which are significantly denser or less porous, being more restrictive of air flow. However, the ventilator may incorporate acoustic foam, if desired, for improving the acoustic characteristics thereof.

In a preferred embodiment, the chamber is elongate and of substantially rectangular cross section, and the cover portion incorporates at least one ventilation aperture, preferably a series of ventilation apertures passing therethrough, e.g. for allowing air to pass into the interior of a space, e.g. a room or other interior space which the ventilator is adapted to service, and vice versa. In this case, the aperture or series of apertures are preferably on one side of the chamber and the apertured wall portion has at least one aperture, preferably a series of apertures spaced along the ventilator, on an opposite side of the chamber. In this case, the foam filter may be located between the aperture or apertures of the apertured wall portion and the aperture or apertures of the cover portion to filter air passing between these apertures. In this case, the thickness of the foam across the chamber from the aperture or apertures in the apertured wall portion to the aperture or apertures in the cover portion is preferably at least 10 mm, 15 to 30 mm being envisaged as typical, the value being 16 mm in one embodiment and 17 mm in another.

Preferably, the foam filter has porosity to air flow such that, at pressure differentials across the ventilator of less than or equal to 30 Pa, with the ventilation path fully blocked by a 17 mm thick section of the foam, the mass flow rate of air through the ventilator at standard atmospheric conditions is at least 60% of the mass flow rate through the ventilator that would result if the foam filter were removed and the ventilator was otherwise unchanged.

Where the ventilator includes an apertured wall portion and a flap pivotally mounted thereon, the ventilator preferably has snib means for operating the flap. Preferably, the ventilator is adapted to be located with the flap on an exterior side of the apertured wall portion and with the snib means providing a linkage to a manually operable snib to the interior side of the apertured wall portion and/or the ventilator or window or door assembly to which it may be mounted. The snib means may include one or more detents for locking the flap in a selected angular orientation relative to the apertured wall portion. The flap may be pivotally mounted at an upper edge thereof to the apertured wall portion and may include a seal at a lower edge thereof.

Another aspect of the invention provides a window or door assembly having a ventilator as set out in any of the above mentioned aspects of the invention mounted therein for providing ventilation from one side of the assembly to the other.

The assembly may comprise a window assembly having a first pane of window glazing which is surrounded by a peripheral sash frame the ventilator being a glazed-in ventilator which is located between an edge of the pane of window glazing and the peripheral sash frame. The assembly may include a second pane of window glazing which is surrounded by a second peripheral sash frame, the first and second peripheral sash frames being located inside a fixed frame, the first and second sash frames being planar, mutually parallel and offset from one another. Preferably, at least one of the sash frames is slidable in the sash frame to an open configuration of the window assembly. When the window assembly is located in situ on a building structure such as a wall of a space such as a room, the first sash frame may be located to the interior of the second sash frame and the ventilator may project in an exterior direction no further than the first sash frame (i.e. the ventilator is flush or sub-flush). In this case, at least one of the sash frames may be slidable in the fixed frame to an open configuration of the window assembly in which the ventilator is at least partly overlapped, when viewed in a direction orthogonal to the sash frames, with the second pane of window glazing. This structure, in which the ventilator has zero exterior projection therefore allows convenient sliding opening of the window assembly. If the ventilator were to project sufficiently to the exterior, it might adversely prevent or jam such sliding movement.

The present invention may be carried out in various ways and one preferred ventilator and window assembly incorporating the ventilator will now be described by way of example with reference to the accompanying drawings in which.

Figure 1:
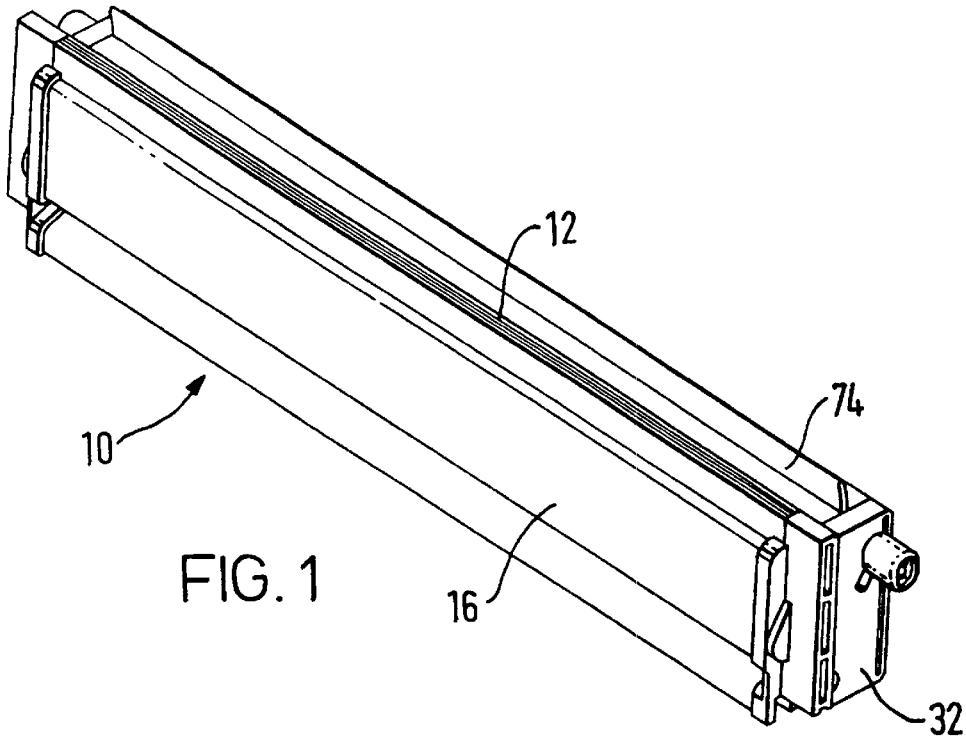
FIG. 1 is an isometric view of a preferred ventilator in accordance with an embodiment of the present invention from an exterior side thereof.
Figure 2:
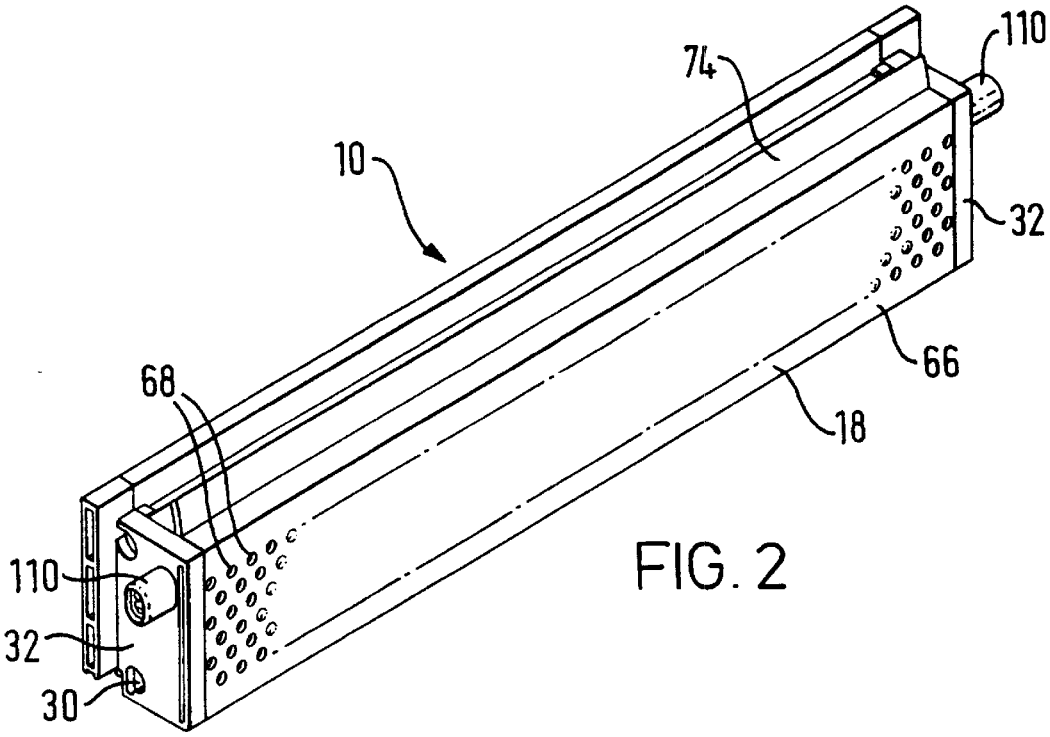
FIG. 2 is an isometric view of the ventilator from the interior side thereof.
Figure 4:
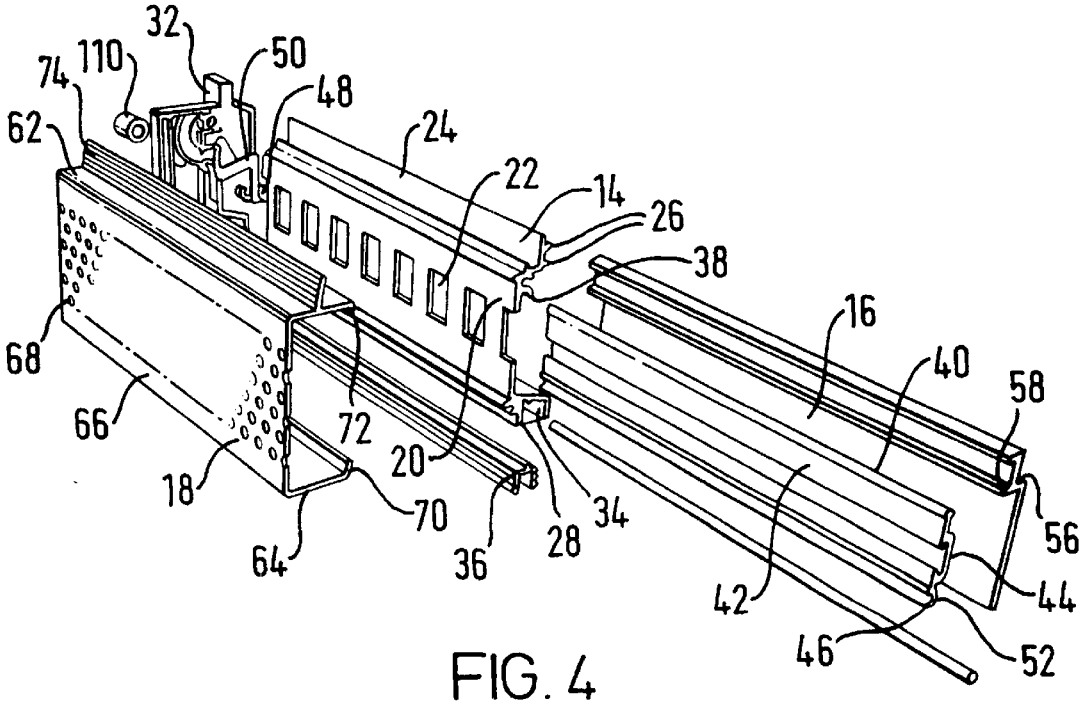
FIG. 4 is an exploded view of the sectioned part of the ventilator shown in FIG. 3.

Referring to the drawings, the exploded view of FIG. 4 and FIGS. 1 and 2 show that a preferred ventilator 10 includes a housing 12 formed by an apertured wall portion 14 an exterior weather hood 16 and a cover portion 18. The apertured wall portion 14, weather hood 16 and cover portion 18 are elongate extrusions.

The apertured wall portion 14 includes a generally vertical barrier wall 20 which is perforated by a series of apertures 22 formed therethrough and distributed evenly along the length thereof. The apertured wall portion 14 also includes an upstanding flange 24 from which extend elongate diverging flanges 26 which are adapted to engage the weather hood 16.

In addition, the apertured wall portion includes extruded elongate sockets 28 which are adapted to be engaged by screws (not shown) passing through fixing apertures 30 which pass through end caps 32 of the ventilator 10.

In addition, the apertured wall portion 14 includes a lower channel portion 34 which is adapted to engage a lower glazing gasket 36 of the ventilator 10.

The apertured wall portion 14 also includes, above the apertures 22, a hinge socket 38 which is adapted to pivotally engage a part-cylindrical hinge portion of a rotatable flap 42 of the ventilator.

The rotatable flap 42 is an extrusion and, apart from the hinge portion 40 includes a generally downwardly extending wall part 44 which, in a closed orientation thereof, is located adjacent and blocks air flow through the apertures 22. The wall part 44 includes an extruded snib socket 46 for engaging a tongue 48 of an interior snib element 50. At a lower edge of the wall part 44, the flap 42 includes a socket 52 for holding a gasket 54.

The weather hood 16 includes a generally L-shaped hood portion 56 which includes an elongate horizontal flange 58 and a vertical flange 76 which extends down from the horizontal flange 58, once the ventilator is assembled, down past and below the apertures 22 in the apertured wall portion 14. A vertical flange 76 extends vertically upwards from midway across the horizontal flange 58 and terminates at a lateral flange 78 which extends from the vertical flange convergingly towards the flange 58.

The cover portion 18 is generally C-shaped in cross section having horizontal upper and lower walls 62,64 joined together by a vertical wall 66 which is perforated by a series of ventilation apertures 68 arranged in a honeycomb distribution. The lower wall 64 includes an upwardly extending bead 70 which is adapted to removably snap fittingly clip to the apertured wall portion 14 along with a downwardly extending bead 72 of the upper wall 62. An upwardly extending grip rail 74 extends up from the upper wall 62 of the cover portion 18.

The end caps 32 are mirror images of each other. The end cap shown towards the left of FIG. 4 is shown enlarged in FIGS. 8A and 8B. During assembly of the ventilator which will be described later, the end caps are attached to either end of the housing 12 of the ventilator 10. The end cap 32 shown in FIGS. 8A and 8B includes a glazing bar 80 whose width D is 6 mm so that the ventilator is most suitable for use with 6 mm wide window glazing, e.g. single glazing. The width D may vary from embodiment to embodiment to match different thicknesses of glazing. Likewise, the width of the lower channel 34 of the apertured wall portion 14 may be varied, as may the gasket 36 and the flanges 26,78 to accommodate different widths of glazing, e.g. thicker widths for double glazing. In addition or alternatively spacing connectors may be employed between parts of the ventilator on opposite sides of the glazing.

On an exterior side 82 (i.e. a side adapted to be located on the exterior of a window or door assembly) thereof, the end cap 32 includes a channel 84 for engaging the weather hood 16. To an interior side 86 of the glazing bar 80 the end cap includes a generally rectangular end wall 88 which forms an end wall of a filter chamber 90 (FIG. 5) of the ventilator. Towards an interior side 92 of the end wall 88, the end wall 88 includes a cover stop flange 94 which is vertically extending and which is adapted to engage the vertical wall 66 of the cover portion 18 to locate the cover portion 18 in position on the ventilator 10.

Figure 8A:
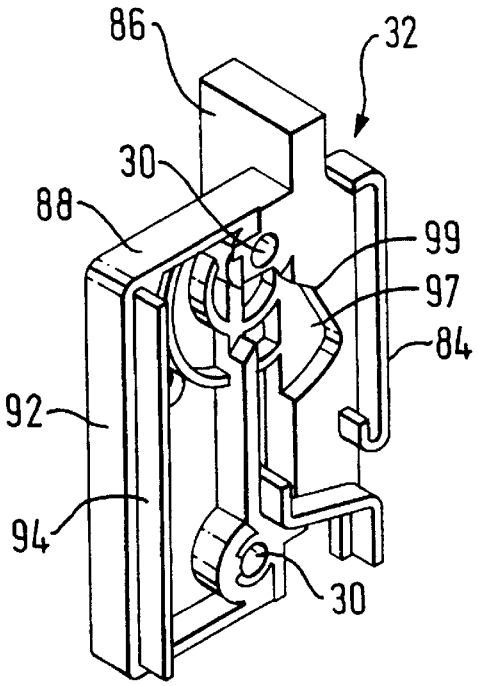
FIGS. 8A and 8B are perspective views of an end cap of the ventilator.
Figure 8B:
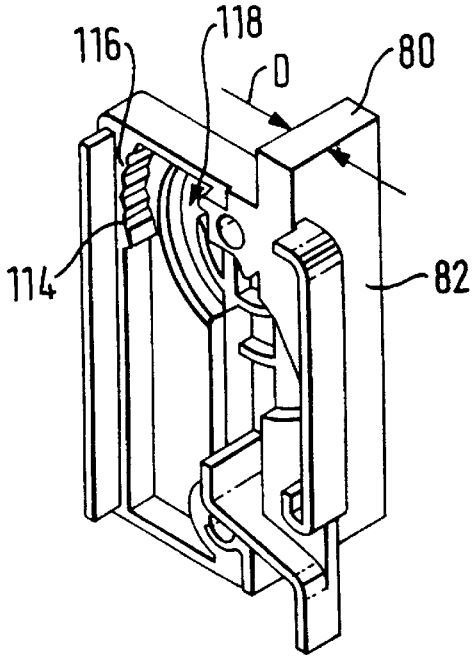
Figure 9A:
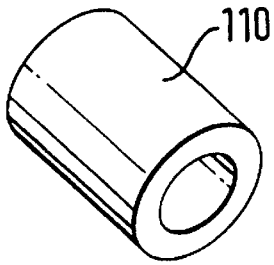
FIGS. 9A and 9B are, respectively, a perspective and sectioned view of an external manually operable snib of the ventilator.
Figure 9B:
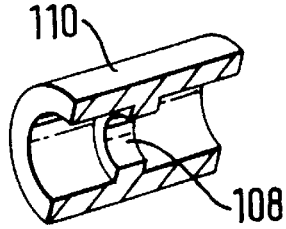
Figure 10:
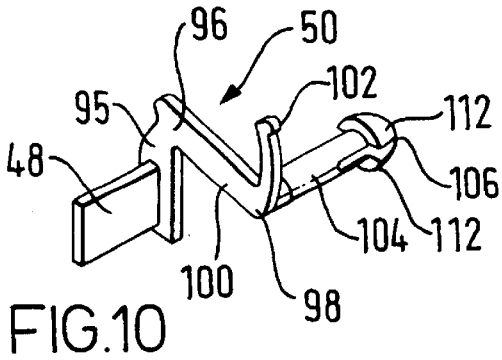
FIG. 10 is a perspective view of an internal operating snib of the ventilator.

As shown in FIG. 4 and FIGS. 8A and 8B, the end cap 32 shown in these figures co-operates with the interior snib element 50 which is shown in FIG. 4. The mirror image of this interior snib element is shown enlarged in FIG. 10 from which it will be seen that the tongue 48 of the snib is connected to one arm 95 of a substantially L-shaped crank 96 of the snib element 50. To the distal end 98 of the other arm 100 of the crank 96 there are attached a detent member 102 and an operating leg 104 which terminates at a slotted sprung arrowhead fixture 106. The arrowhead fixture 106 is adapted to pass through an internal bore 108 of an exterior snib 110 which is shown in FIGS. 9A and 9B. As the arrowhead passes through the bore 108, it is compressed and then springs back to a configuration in which the shoulders 112 prevent the exterior snib 110 from being removed from the interior snib 50. It will be appreciated that the interior snib 50 shown in FIG. 10 is, as a mirror image of the snib 50 shown in FIG. 4, suitable for use with the end cap at the other end of the ventilator to the end cap shown in FIG. 4, the two end caps also being mirror images of one another. In addition, it will be appreciated that the snib element 50, once the tongue 48 has been inserted into the snib socket 46 of the flap 42, is adapted to rotate about the hinge formed by the hinge portion 40 of the flap 42 and the hinge socket 38 of the apertured wall portion 14. The end cap 32 also includes a recessed portion 97 including an end stop surface 99 for engagement with the arm 95 in a fully open configuration of the flap 42.

The detent member 102 is adapted to engage selectively with a series of detents 114 of a detent portion 116 of the end cap 32. The end cap also includes an arcuate slot 118 through which the operating leg 104 of the interior snib 50 passes. It will therefore be appreciated that once the ventilator is assembled the crank 96 of the interior snib and detent member 102 are inside the chamber 90, the operating leg 104 passes through the slot 118, and the arrowhead fixture 106 is outside the chamber 90.

If it is desirable to have operating snibs at each end of the ventilator, they may be so provided, like in the present embodiment, as shown by the existence in FIG. 2 of the two exterior operating snibs 110. Alternatively, only one snib may be preferred. It may also be desirable to provide permanent ventilation in some circumstances, in which case both of the interior 50 and exterior 110 snibs be omitted at each end of the ventilator and so may the flap 42 to provide permanent ventilation. In addition to or as an alternative to snibs, the ventilator may incorporate one or more remote controls, such as a cord control.

Figure 7:
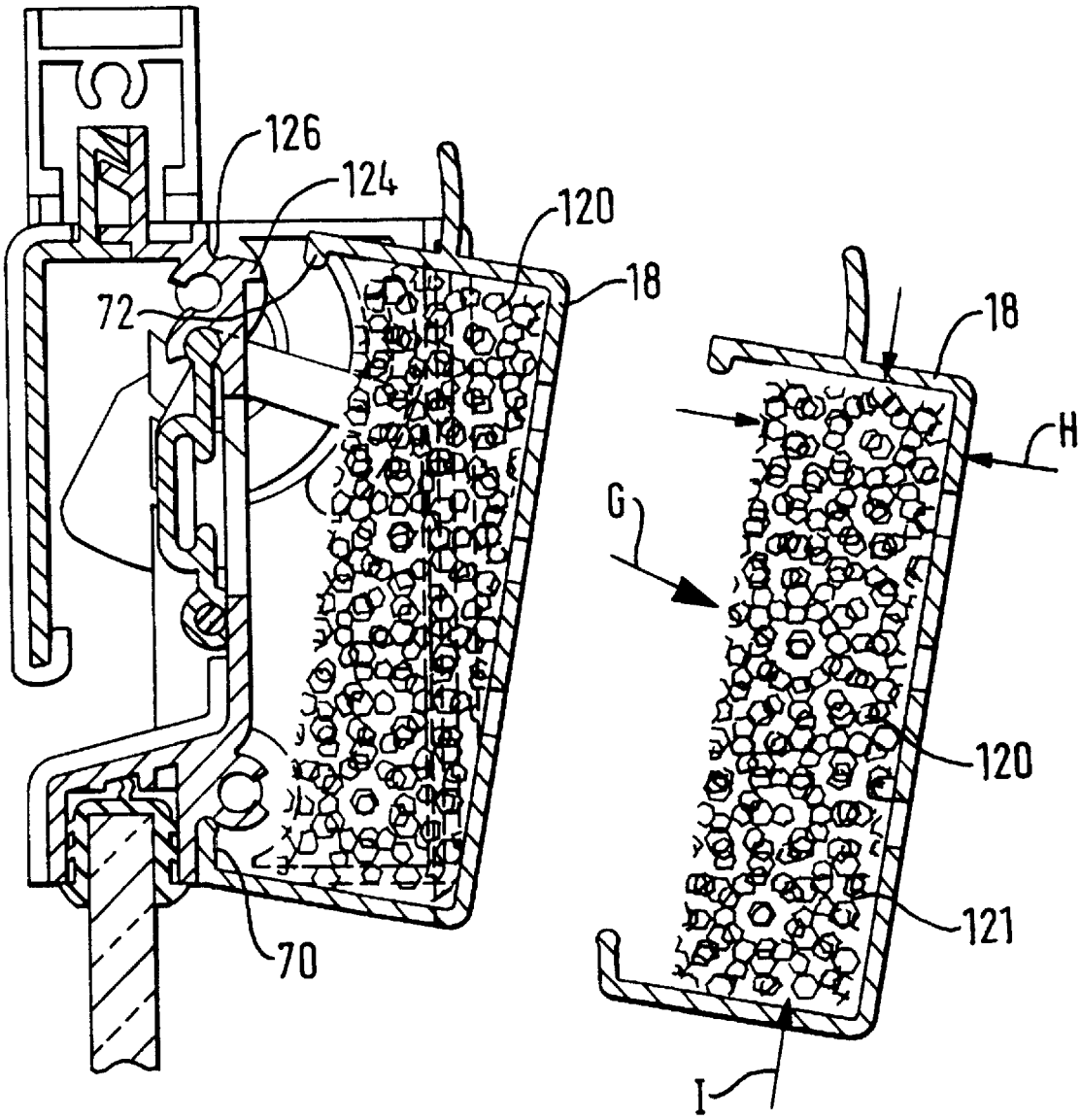
FIG. 7 is an end section view of the ventilator corresponding to that of FIG. 5, but showing a foam filter thereof and schematically depicting a removal of the foam filter and a cover portion of the ventilator.

The method of assembly of the ventilator will now be described. First, the apertured wall portion 14 and weather hood 16 are connected together by sliding the diverging flanges 26 of the apertured wall portion 14 along between the laterally extending flange 78 and horizontal flange 58 of the weather hood 16. Next, the gasket 54 is pushed into the socket 52 at the bottom of the flap 42 and the hinge portion 40 of the flap 42 is longitudinally slid into the hinge socket 38 of the wall portion 14. Next, the tongues 48 of the interior snibs 50 are inserted at either end of the flap 42 into the snib socket 46. The end caps 32 are then attached to the wall portion 14 by screws (not shown) passing through the apertures 30 of the end caps 32 and into the extruded elongate sockets 28. During this process, the arrowhead 106 of the interior snibs 50 and operating legs 104 thereof pass through the slots 118 of the end caps 32 and the detent members 102 engage with the detent portions 116 of the end caps 32. The exterior snibs 110 are then snap-fitted on to the arrowhead fixtures 106 of the interior snibs 50 and the gasket 36 is inserted into the lower channel 34. An elongate reticulated foam filter 120 having substantially the same length as the wall portion 14 weather hood 16 and flap 42 and having a substantially constant cross section (which is shown in FIG. 7) along the length thereof may then be inserted into the C-shaped cover portion 18 and the cover portion 18 may then be clipped to the wall portion 14 by first engaging the bead 70 below the socket 28 and then pushing the upper bead 72 over an upper horizontally extending ledge 124 of the wall portion 14 and into a detent 126 thereof. Simultaneously, the cover stops 94 engage the vertical wall 66 of the cover portion 18 and the cover portion is resiliently held in position.

In this configuration, the barrier wall 20 of the wall portion 14 and the C-shaped cover portion 18 form a filter chamber 128 (i.e. the chamber 90), containing the filter 120 and closed at either end by the end walls 88 of the end caps 32.

Figure 6:
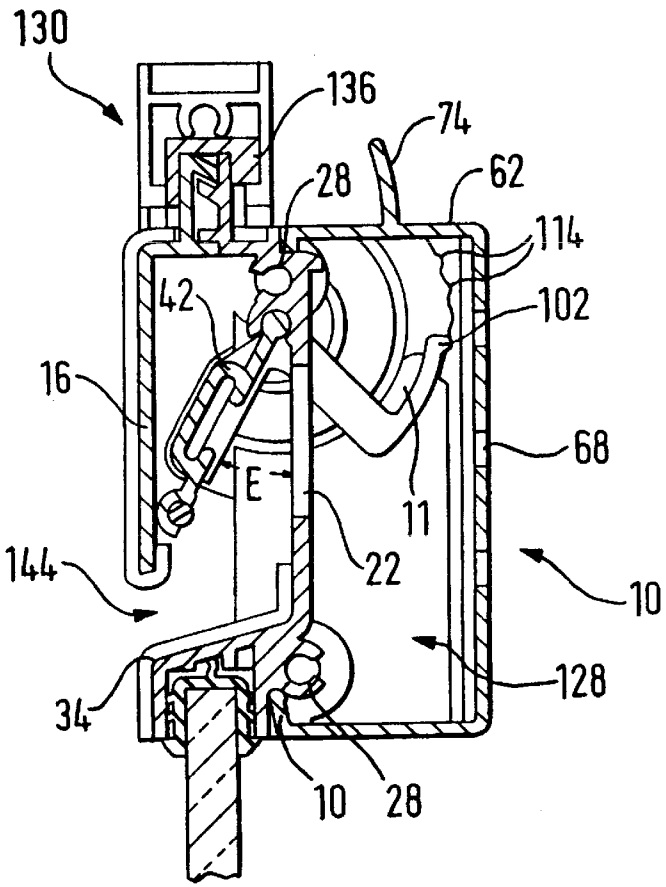
FIG. 6 is a view corresponding to FIG. 5 with the flap in a second position thereof.
Figure 5:
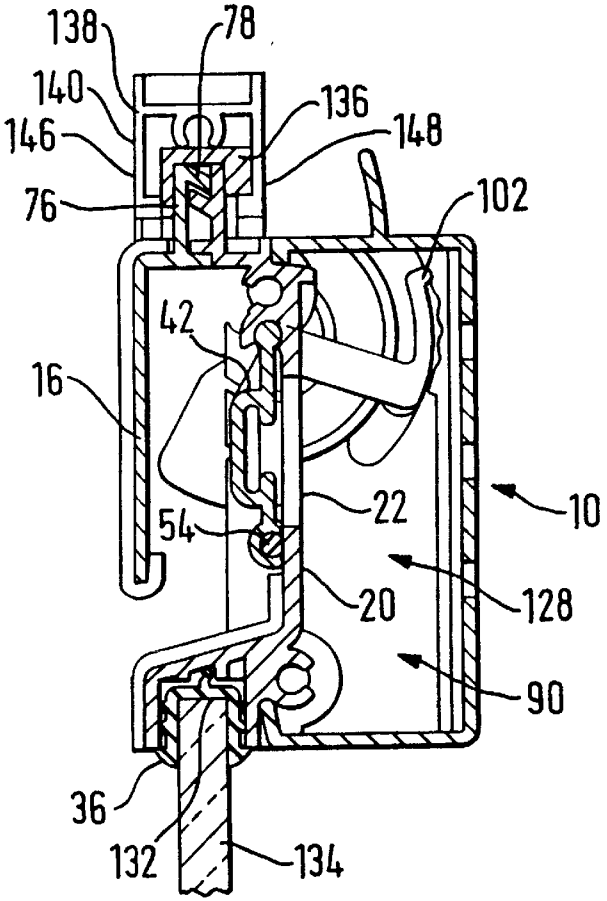
FIG. 5 is an end part-sectioned view of the ventilator glazed-in to a window assembly with a flap thereof in a first position.
Figure 11:
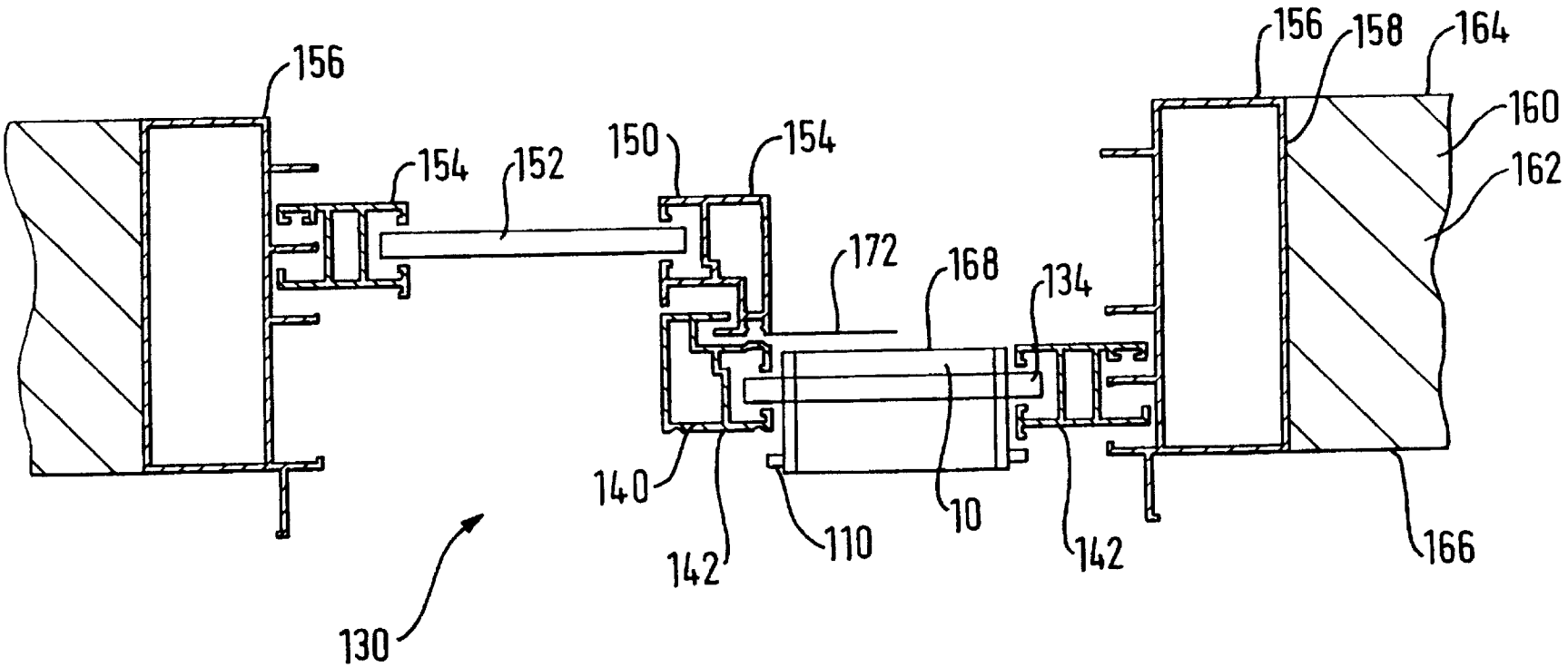
FIG. 11 is a schematic part-sectional view from above of the ventilator installed in a window assembly having horizontal sliding sashes.

The assembled ventilator 10 may then be incorporated in a window assembly 130 as shown in FIGS. 5,6 and schematically in FIG. 11.

In FIG. 5 it will be seen that the ventilator 10 comprises and has been installed as a glazed-in ventilator by engaging the gasket 36 with the top edge 132 of a 6 mm wide single-glazed window 134 and by engaging the upstanding flange 24 of the wall portion 14 and vertical flange 76 of the hood 16 with a sash gasket 136 of an upper spar 138 of a rectangular sash frame 140 of the window assembly 130. The sash 140 also includes a lower spar (not shown) and vertically extending side spars 142 which are shown in FIG. 11.

In the configuration shown in FIG. 6—the filter 120 is for clarity not shown in FIGS. 5 and 6—the flap 42 is in a fully open position thereof. Air may flow into the housing 12 through an elongate slot 144 located below the hood 16 and above the channel portion 34. The air flow may then continue through the apertures 22 and the filter chamber 128, where it is filtered by the filter 120, before exiting the ventilator through the apertures 68 of the cover 18. If it is desirable to restrict the level of ventilation, one of the exterior snibs 110 may be moved up so that the detent 102 engages a higher one of the detents 114. The flap 42 may be rotated a total angle E of 28° until the detent 102 engages the top one of the detents 114 to lock the flap 42 in the closed position shown in FIG. 5, in which the gasket 54 seals against the barrier wall 20, below the apertures 22. In this configuration, no ventilation may pass through the ventilator 10 from an exterior side 146 of the window assembly 130 to an interior side 148 thereof. In other embodiments, it may be desirable to provide a minimum ventilation configuration in which a certain minimum level of ventilation is guaranteed, such as by including fewer detents on the detent portion 116 of the end cap 32.

Referring to FIG. 11, the window assembly 130 includes a second sash 150 having a second pane of glazing 152. The sash 150 is rectangular and includes vertical side spars 154 and horizontal spars at the top and bottom thereof (not shown) and the sashes 140, 150 are located inside a fixed outer frame 156 which is secured inside an aperture 158 formed through an exterior wall 160 of a building 162. It will therefore be appreciated that the ventilator 10, while the sashes 140, 150 are in their closed positions shown in FIG. 11, controls or permits ventilation to pass between an exterior side 164 and an interior side 166 of the wall 160, and vice versa.

Figure 3:
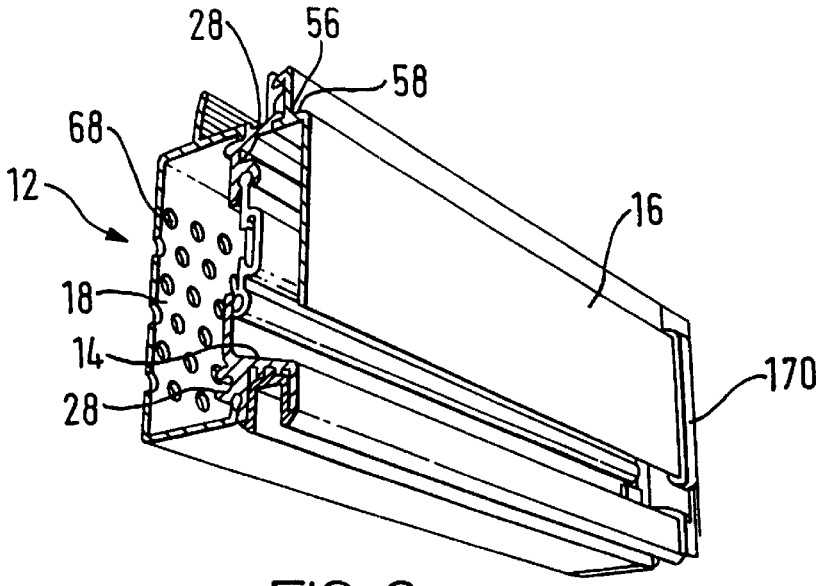
FIG. 3 is a perspective view of the ventilator sectioned at a point approximately half way along the length thereof.

If it is desirable to open the window assembly 130, such as to provide significant ventilation or to clean the exterior of the glazing 134, 152 while one is inside the building 162, the sash 140 may be moved to the left as shown in FIG. 11 or the sash 150 to the right. This opening is enabled by the extremely minimal forward projection of the hood 16 towards the exterior of the window assembly. In particular, the plane 168 of the exterior most parts of the ventilator 10, i.e. the hood 16 or the part 170 (FIG. 3) of the end cap 32 which engages the hood 16, is spaced to the interior of the plane 172 of the interior most parts of the sash 150.

After a considerable period of service, it may be desirable to service the filter 120, such as if it has become clogged with dust or other debris (not shown). In this case, the grip rail 74 may be gripped and pulled in the direction G shown in FIG. 7 to rotate the cover portion 18 about the bead 70 to the position of the cover 18 shown on the left in FIG. 7, and the cover may then be totally removed from the wall portion 14 and the rest of the ventilator 10 to the position shown on the right in FIG. 7, taking with it, the filter 120. The filter may then be removed from the cover 18 and cleaned for further service, or replaced. The cover 18 may simply be reattached to the wall portion 14 to form the chamber 128 again, containing the so cleaned or replaced filter 120.

The particular foam filter used in this embodiment is a block of reticulated polyurethane foam available under the trade name BULPREN S 10. The foam has a thickness dimension H between the apertures 22 and apertures 68 of 16 millimetres and a height dimension 1 of 54 millimetres. The cellular network of the foam is substantially entirely open and the ribs 121 thereof have a volume of about 3% of the total foam volume. The density of the foam is from 26 to 32 kg per meter cubed and the porosity is nominally 10 pores per inch, being approximately between 7 and 15 pores per inch.

Alternatively, other BULPREN S foams with smaller pores may be employed, such as BULPREN S 20, S 30, S 45, S 80 or S 100, but it is anticipated that these will cause increasingly large losses of mass flow rate, due to the smaller pores. All of the BULPREN products mentioned above are available from Recticel Ltd., bluebell Close, Clover Nook Industrial Estate, Alfreton, Derbyshire, DE55 4RD, United Kingdom.

It is quite unexpected that a slot ventilator or glazing ventilator could provide sufficient ventilation with the air flow passing through a reticulated foam filter. However, tests carried out using a similar ventilator to that described above showed that a 17 millimetre thick reticulated foam caused less than 40% reduction in air flow through the ventilator at pressure differentials across the ventilator of less than 30 Pa.

The end caps 32, interior snib elements 50 and exterior snibs 110 are moulded of plastics. The gaskets 36,54 are extruded of soft plastics materials. The flap 42, apertured wall portion 14, hood portion 16, and cover portion 18 are extruded anodised or painted aluminium alloy. However, the uses of other materials for these components are envisaged. After extrusion, the apertured wall portion 14 and cover portion 18 are punched or drilled to form the apertures 22,68.

The above description is of a preferred embodiment only. Many modifications may be made without departing from the scope of the invention which is defined by the accompanying claims in accordance with patent law.

What is claimed is:

1. A ventilator comprising a body which is adapted to be located adjacent a window or door at a ventilation path between two sides of the window or door, the body including a chamber which is adapted to contain a filter for filtering air passing through the ventilation path;

wherein the chamber contains a filter, and at least part of the chamber is defined by a removable cover portion of the body, the filter being removable from the body on removal of the cover portion.

2. A ventilator comprising a body which is adapted to be located adjacent a window or door at a ventilation path between two sides of the window or door, the body including a filter for filtering air passing through the ventilator, in which the body includes a chamber containing the filter, and at least part of the chamber is defined by a removable cover portion of the body;

wherein the chamber is partly defined by an apertured wall portion of the body, the cover portion being removably mounted to the apertured wall portion, the ventilator being adapted to be mounted in a window or door assembly with the cover portion on an interior side of the window or door.

3. A ventilator as claimed in claim 2 in which the body includes a closure for controlling the level of ventilation through the ventilator.

4. A ventilator as claimed in claim 3 in which the closure comprises a flap which is pivotally coupled to the apertured wall portion on one side thereof, the filter and cover portion being located on an opposite side thereof.

5. A ventilator device comprising a window assembly having a ventilator mounted thereon, the ventilator comprising a body which is adapted to be located adjacent a window of the window assembly at a ventilation path between two sides of the window, the body including a filter for filtering air passing through the ventilator, the assembly having a first pane of a window glazing which is surrounded by a first peripheral sash frame, the ventilator being glazed-in and located between an edge of the pane of the window glazing and the first peripheral sash frame, further including a second pane of window glazing which is surrounded by a second peripheral sash frame, the first and second peripheral sash frames being located inside a fixed frame, the first and second sash frames being planar, mutually parallel and offset from one another in a direction orthogonal to their planar orientations;

wherein the first sash frame is located to the interior of the second sash frame and the ventilator is flush or sub-flush relative to the forward most part of the first sash so that the sash frames are slidable in the fixed frame to an open configuration of the window assembly in which the ventilator is at least partially overlapped, when viewed in an exterior or interior direction orthogonal to the sash frames, with the second pane of window glazing.

6. A ventilator comprising a body which is adapted to be located adjacent a window or door at a ventilation path between two sides of the window or door, the body including a chamber which is adapted to contain a filter for filtering air passing through the ventilation path;

wherein the chamber contains a filter, and at least part of the chamber is defined by a removable cover portion of the body, the filter being removable from the body on removal of the cover portion; and wherein the chamber is partly defined by an apertured wall portion of the body, the cover portion being removably mounted to the apertured wall portion, the ventilator being adapted to be mounted in a window or door assembly with the cover portion on an interior side of the window or door.

7. A ventilator as claimed in claim 6 in which the body includes a closure for controlling the level of ventilation through the ventilator.

8. A ventilator as claimed in claim 7 in which the closure comprises a flap which is pivotally coupled to the apertured wall portion on one side thereof, the filter and cover portion being located on an opposite side thereof.

9. A ventilator as claimed in claim 1 in which the filter comprises a reticulated foam filter.

10. A ventilator as claimed in claim 9 in which the foam of the filter is substantially fully open celled.

11. A ventilator as claimed in claim 9 in which the porosity of the foam of the filter is between 7 and 100 pores per inch.

12. A ventilator as claimed in claim 11, in which the porosity of the foam of the filter is between 7 and 15 pores per inch.

13. A ventilator as claimed in claim 9 in which the foam of the filter has a density of between 20 and 40 kilograms per cubic meter.

14. A ventilator as claimed in claim 13, in which the foam of the filter has a density of between 26 and 32 kilograms per cubic meter.

15. A ventilator as claimed in claim 9 in which volume of foam ribs of the foam filter is 1 to 10% of the overall volume of the foam filter.

16. A ventilator as claimed in claim 15, in which volume of foam ribs of the foam filter is 2 to 5% of the overall volume of the foam filter.

17. A ventilator as claimed in claim 16, in which volume of foam ribs of the foam filter is about 3% of the overall volume of the foam filter.

18. A ventilator comprising a body which is adapted to be located adjacent a window or door at a ventilation path between two sides of the window or door, the body including a filter for filtering air passing through the ventilator, in which the body includes a chamber containing the filter, wherein the filter is removable from the chamber when the body is situated adjacent the window or door;

wherein the chamber is partly defined by an apertured wall portion of the body, the cover portion being removably mounted to the apertured wall portion, the ventilator being adapted to be mounted in a window or door assembly with the cover portion on an interior side of the window or door.

19. A ventilator as claimed in claim 18 in which the body includes a closure for controlling the level of ventilation through the ventilator.

20. A ventilator as claimed in claim 19 in which the closure comprises a flap which is pivotally coupled to the apertured wall portion on one side thereof, the filter and cover portion being located on an opposite side thereof.

21. A combination ventilator and window or door comprising a body which is located adjacent the window or door at a ventilation path between two sides of the window or door, the body including a filter for filtering air passing through the ventilator, in which the body includes a chamber containing the filter, and at least part of the chamber is defined by a removable cover portion of the body;

wherein the chamber is partly defined by an apertured wall portion of the body, the cover portion being removably mounted to the apertured wall portion, the ventilator being mounted in the window or door with the cover portion on an interior side of the window or door.

22. A ventilator as claimed in claim 21 in which the body includes a closure for controlling the level of ventilation through the ventilator.

23. A ventilator as claimed in claim 22 in which the closure comprises a flap which is pivotally coupled to the apertured wall portion on one side thereof, the filter and cover portion being located on an opposite side thereof.

24. A combination ventilator and window or door comprising a body which is located adjacent a window or door at a ventilation path between two sides of the window or door, the body including a filter for filtering air passing through the ventilator, in which the body includes a chamber containing the filter, wherein the filter is removable from the chamber;

wherein the chamber is partly defined by an apertured wall portion of the body, the cover portion being removably mounted to the apertured wall portion, the ventilator being mounted in the window or door with the cover portion on an interior side of the window or door.

25. A ventilator as claimed in claim 24 in which the body includes a closure for controlling the level of ventilation through the ventilator.

26. A ventilator as claimed in claim 25 in which the closure comprises a flap which is pivotally coupled to the apertured wall portion on one side thereof, the filter and cover portion being located on an opposite side thereof.

* * * * *

UNITED STATES PATENT AND TRADEMARK OFFICE

CERTIFICATE OF CORRECTION

PATENT NO. : 6,558,247 B1
DATED : May 6, 2003
INVENTOR(S) : Richard Allan Peak

It is certified that error appears in the above-identified patent and that said Letters Patent is hereby corrected as shown below:

Title page,
Item [57], ABSTRACT,
Line 5, "portion 24" should be -- portion 14 --.

Column 8,
Line 9, "dimension 1" should be -- dimension I --.

Signed and Sealed this

Twenty-fifth Day of November, 2003

JAMES E. ROGAN
*Director of the United States Patent and Trademark Office*